US008251075B2

(12) United States Patent
Breese et al.

(10) Patent No.: US 8,251,075 B2
(45) Date of Patent: Aug. 28, 2012

(54) COSMETIC COMPACT

(75) Inventors: Reginald Breese, Spalding (GB); Paul Adams, Zejtun (MT)

(73) Assignee: Toly Products (U.K.) Limited (GB)

( * ) Notice: Subject to any disclaimer, the term of this patent is extended or adjusted under 35 U.S.C. 154(b) by 87 days.

(21) Appl. No.: 12/681,110

(22) PCT Filed: Sep. 18, 2008

(86) PCT No.: PCT/GB2008/003194

§ 371 (c)(1),
(2), (4) Date: Apr. 1, 2010

(87) PCT Pub. No.: WO2009/044099

PCT Pub. Date: Apr. 9, 2009

(65) Prior Publication Data

US 2010/0218782 A1 Sep. 2, 2010

(30) Foreign Application Priority Data

Oct. 1, 2007 (GB) ..... 0719143.0

(51) Int. Cl.
*A45D 33/02* (2006.01)

(52) U.S. Cl. ..... 132/299

(58) Field of Classification Search ..... 132/314–317, 132/298–299, 303; 222/182–183, 105, 383.1; 401/188 R, 137, 157; 220/4.21, 4.24, 4.25
See application file for complete search history.

(56) References Cited

U.S. PATENT DOCUMENTS 3,199,743 A * 8/1965 Berger ..... 222/632
4,795,063 A * 1/1989 Sekiguchi et al. ..... 222/105
4,982,751 A 1/1991 Oishi et al.
6,510,965 B1 * 1/2003 Decottignies et al. ..... 222/95
6,536,447 B1 * 3/2003 Fioravanti et al. ..... 132/299
(Continued)

FOREIGN PATENT DOCUMENTS

EP 1500437 1/2005
(Continued)

OTHER PUBLICATIONS http://www.airlesspackassociation.com/How-does-it-work,48.html.*

(Continued)

*Primary Examiner* — Todd Manahan
*Assistant Examiner* — Jennifer Gill
(74) *Attorney, Agent, or Firm* — Dean W. Russell; Kristin M. Crall; Kilpatrick Townsend & Stockton LLP

(57) ABSTRACT

A cosmetic compact comprising a lid (2) hingedly connected to a base (3), a dispensing orifice (20) and a cosmetic dispenser (10) for dispensing liquid cosmetics disposed in a recess in the base. The cosmetic dispenser (10) comprises a pump mechanism (14) and an actuator (12). The pump mechanism (14) being operatively connected to the actuator (12) so as to actuate the dispenser (10). The actuator (12) being attachable to a plunger (35) of the pump mechanism (14) and comprising an actuating linkage (23) having a portion offset to the plunger axis such that when pressure is applied to the actuating linkage (23) in a direction transverse to the plunger axis the plunger (35) moves axially. The compact further comprises an inner lid (11) hingedly connected to the base (3), the inner lid (11) comprising a button (7) in cooperation with the actuator (12) such that when pressure is applied to the button (7) the plunger (35) moves axially to expel liquid from the dispensing orifice (20).

22 Claims, 5 Drawing Sheets

U.S. PATENT DOCUMENTS

| | | | | |
|---|---|---|---|---|
| 6,543,653 | B2 * | 4/2003 | Lamboux | 222/321.8 |
| 7,597,211 | B2 * | 10/2009 | Kang, III | 220/367.1 |
| 2002/0113093 | A1 * | 8/2002 | De Laforcade | 222/321.9 |
| 2002/0134798 | A1 | 9/2002 | Lamboux | |
| 2002/0175189 | A1 | 11/2002 | Petit | |
| 2003/0155378 | A1 | 8/2003 | Petit | |
| 2005/0089358 | A1 * | 4/2005 | Py et al. | 401/40 |
| 2007/0151987 | A1 * | 7/2007 | Arghyris et al. | 222/386.5 |
| 2008/0264973 | A1 * | 10/2008 | LaFlamme et al. | 222/207 |

FOREIGN PATENT DOCUMENTS

| | | | |
|---|---|---|---|
| FR | 2821766 | | 3/2001 |
| FR | 2859464 | | 3/2005 |
| GB | 2434361 | A * | 7/2007 |
| JP | 9225357 | | 2/1996 |
| JP | 10120054 | | 10/1996 |
| JP | 2004-208973 | A * | 7/2004 |
| JP | 2004-208975 | A * | 7/2004 |
| WO | WO00144076 | | 6/2001 |
| WO | WO2005012135 | | 2/2005 |

OTHER PUBLICATIONS

International Search Report dated Dec. 18, 2008 in Application No. PCT/GB2008/003194.

Combined Search and Examination Report dated Feb. 4, 2008 in Application No. GB0719143.0.

* cited by examiner

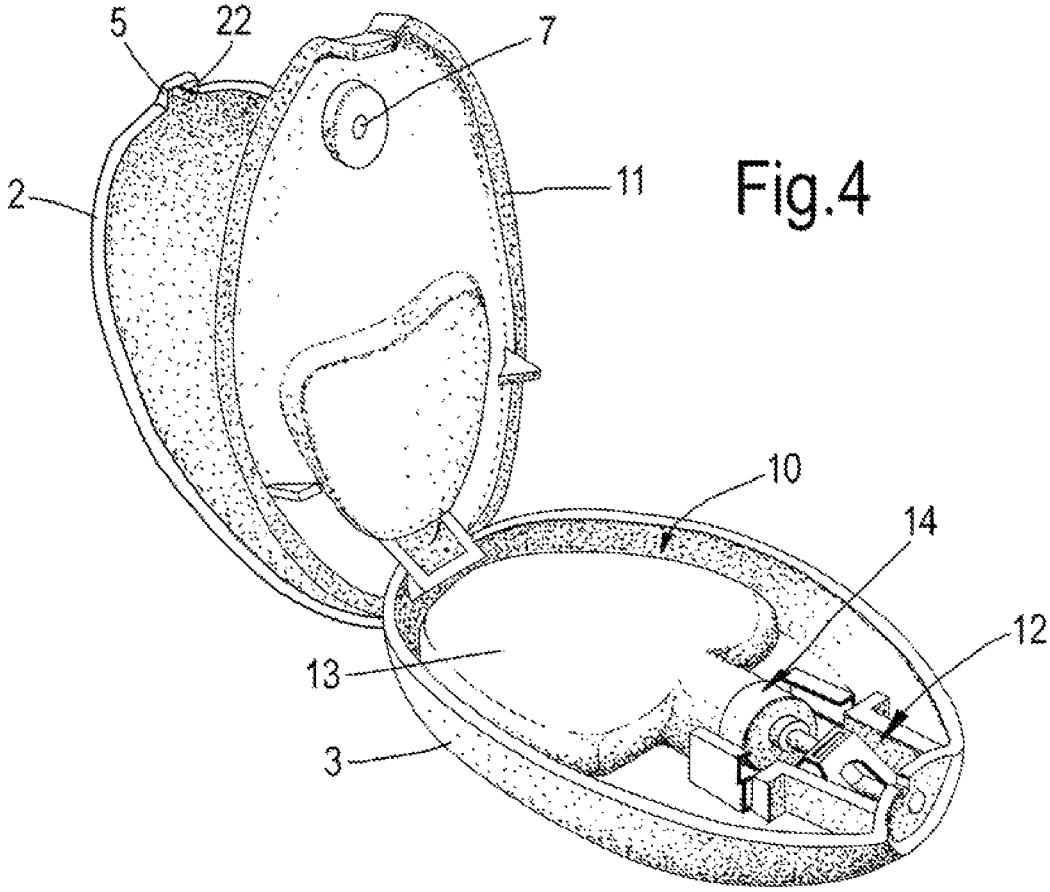
Fig.4
Fig.5
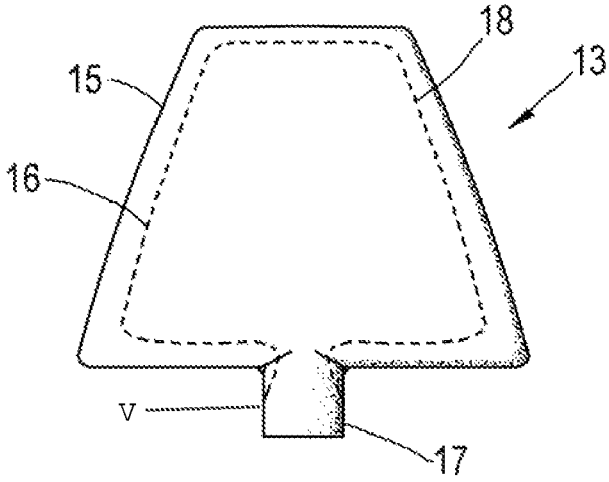

COSMETIC COMPACT

CROSS REFERENCE TO RELATED APPLICATIONS

This application is the U.S. national phase of International Application No. PCT/GB200/003194 filed on Sep. 18, 2008 and published in English on Apr. 9, 2009 as International Publication No. WO 2009/044099 A1, which application claims priority to Great Britain Application No. 0719143.0 filed on Oct. 1, 2007, the entire contents of both of which are incorporated herein by reference.

BACKGROUND OF THE INVENTION

The present invention relates to a dispenser for liquid and semi-liquid cosmetics such as foundation liquid, creams, pastes and the like (hereafter "liquid cosmetics"). The present invention also relates to a cosmetic compact containing the dispenser which conveniently stores and dispenses the liquid cosmetic product. The compact may also store other items such as an applicator sponge or mirror.

Most cosmetic compacts contain cosmetic materials in solid, paste or powder form. Compacts for applying more mobile liquid cosmetics by means of a pump dispenser are known. In a majority of cases, the compacts can only be operated in a limited orientation of the compact, i.e. in a normal upright orientation. This is typical where the pump dispenser operates by virtue of a dip tube submerged in the liquid to be dispensed. This can be problematic when there is a desire to operate the compact in another orientation such as upside down or when the user is lying down.

One such attempt to overcome such a problem is to use an 'airless dispenser' as disclosed in FR2821766. The dispenser comprises of a supple pouch containing the liquid product and an outer compressible bulb with an air inlet valve. The bulb is flexible and forms an air space around the pouch, allowing the air space to be pressurised and the pouch to be compressed to expel a portion of the product when the bulb is squeezed in the hand. The pressure applied to the pouch allows the dispenser to operate in any orientation of the dispenser. However, there is still the problem that since the outer bulb is flexible it is prone to be accidentally compressed when handled or when loosely stored in a bag such as a hand bag. This is particularly the case where the user has forgotten to place the lid or stopper on the dispenser or it accidentally falls off the dispenser.

Similarly JP2004208973 describes a cosmetic compact comprising a main body having an inner lid, an outer lid and a base connected by a hinge. The base of the compact comprises of a recess to contain a cosmetic puff and a further recess as a reservoir for dispensed liquid cosmetics. The liquid cosmetic product is supplied from a tube-type container equipped with a pump-type dispenser having an actuating plunger. The outer lid is coupled with the inner lid so as to enclose the tubular container. A push button is attached to the plunger and the outer lid has an opening to expose the push button so that it can be depressed externally of the compact. On pressing the push button, the liquid cosmetic product is dispensed into the reservoir recess. The container wall is flexible so that it can collapse. This can be problematic if the container is replaceable once it becomes empty or when requiring another type of cosmetic, i.e. in the form of a cartridge. Handling the container may cause some of the remaining liquid cosmetic in the container to accidentally exude from the container and soil the user's hands. In addition, the flexible container must be carefully handled when connecting a replacement container onto the pump-dispenser, in order to avoid accidental spillage.

Cosmetics compacts must present a stylish appearance to make them presentable to the user and thus more attractive for purchase. However, since pump-type dispensers can only be actuated by depressing a plunger, the majority of actuating mechanisms require the push button to be directly connected to the plunger. This limits the design flexibility of the compact. For example, in JP2004208973 an opening in the outer lid has to be provided to expose the push-button so causing the push button to protrude from the compact and making the design of the compact unsightly. This is particularly the case if a smooth compact is desired that can be easy to handled and is ergonomically friendly. Moreover, the push-button can only be depressed in a direction along the axis of the plunger making actuation of the pump-type dispenser difficult and cumbersome to use. In the most extreme case, the user may have to handle the compact in one hand and operate the push button with the other hand. With such a compact, the user has to dispense the liquid cosmetic in a reservoir recess prior to application. Any excess liquid cosmetic liquid that is not used is therefore wasted.

Furthermore, having an opening in the outer lid to expose the push button increases the risk of accidental actuation of the pump dispenser. This is particularly the case, when the compact is loosely carried in the user's bag.

WO 01/44076 (Techniplast) describes an actuator attachable onto a pump-dispenser for dispensing fluids, liquids or pasty material whereby the user applies pressure on the actuator transversely to the longitudinal direction of the axis of the pump-dispenser. The actuator comprises two toggle joint lever arms hinged at an intermediate portion. The free ends of the two arms opposed to the hinge form longitudinal end parts for transmitting force, and which form an obtuse angle in the rest position. When transverse force is applied at the hinge, the angle increases and this generates a longitudinal sliding force on the pump-dispenser to dispense the product. Although this overcomes the problem of providing an actuator which does not suffer from the problem of complex moving parts accessible from the outside of any casing to which it is installed and being detrimental to its ergonomics, there is no disclosure of using the actuator for cosmetic material, particularly in a cosmetic compact. A casing or container incorporating the pump dispensing mechanism described in WO 01/44076 (Techniplast) suffers from the problem that the button for actuating the pump mechanism is located on an external wall of the container and therefore vulnerable to accidental actuation.

U.S. Pat. No. 4,982,751 (Oishi) describes a cosmetic compact for discharging cosmetic material comprising a case body having a base and an outer lid. A flat plate is disposed movably in the case body and a sealed sac to be filled with the cosmetic material disposed under this flat plate. A pump having a cylinder and a piston capable of being driven by the flat plate to discharge the cosmetic material is provided in the sealed sac. A cover is stretched over the upper surface of the flat plate to cover the discharge hole. A slit is formed in the cover so as to communicate with the discharge hole. In order to discharge the cosmetic material the flat plate is pressed in a direction along which the piston moves. An applicator such as a cosmetic sponge on top of the flat plate is thereby impregnated with the cosmetic material when the flat plate is depressed. Although the mechanism for discharging the cosmetic material is protected from accidental actuation by the outer lid, the button or flat plate for actuating the pump dispenser is limited by the direction in which the piston moves, thus reducing any design freedom of the cosmetic compact. In addition, having the dispensing orifice located on the flat plate for actuating the pump mechanism would mean that any excess cosmetic material discharged is likely to build up around the dispensing orifice or slit on the cover and thus remain within the cosmetic compact. This will not only cause the excess cosmetic material to dry up on the cover causing contamination of fresh cosmetic material discharged from the sac but also any cosmetic material not used is wasted.

A cosmetic dispenser having a pump-type dispenser is thus required that does not suffer from the above described problems and incorporates an actuator to actuate the pump-type dispenser that does not restrict the design flexibility of the compact.

SUMMARY OF THE INVENTION

The present invention has mitigated the above problems by providing a cosmetic compact comprising a lid hingedly connected to a base, a dispensing orifice, a cosmetic dispenser for dispensing liquid cosmetics disposed in a recess in the base, the cosmetic dispenser comprising a pump mechanism and an actuator, the pump mechanism being operatively connected to the actuator so as to actuate the dispenser, the actuator being attachable to a plunger of the pump mechanism and comprising an actuating linkage having a portion offset to the plunger axis such that when pressure is applied to the actuating linkage in a direction transverse to the plunger axis the plunger moves axially wherein the compact further comprises an inner lid hingedly connected to the base, the inner lid comprising a button in cooperation with the actuator such that when pressure is applied to the button the plunger moves axially to expel liquid from the dispensing orifice.

Having an actuating linkage with a portion offset to the plunger axis allows a separate actuating button to be provided independent of the plunger and not directly connected to the plunger. This allows a button to be provided on an inner lid in cooperation with the actuator such that the pump dispenser can easily be actuated by applying pressure in a direction transverse to the plunger and in any orientation of the dispenser by pressing the button. The ability to actuate the pump dispenser transversely of the plunger by the actuating linkage greatly improves the design flexibility of any compact to which the actuator is assembled, e.g. removing the need to have unsightly protrusions. The actuating button can be made substantially flush with the upper surface of the compact body for example, with a dispensing orifice located in one end or end wall of the body. Moreover, this also prevents any inadvertent actuation of the button since the inner lid is protected by the outer lid in a closed state. This is particularly important since the cosmetic compact is usually placed loosely inside a bag and is vulnerable to be knocked by other items in the bag.

Preferably, the particular arrangement of the pump mechanism disposed in a recess in the base of the cosmetic compact and having an inner lid with a button for actuating the pump mechanism enables the dispensing orifice to be located at the front of the cosmetic compact. This allows the user to sparingly apply sufficient cosmetic material to an applicator without any loss of cosmetic material or without discharging too much cosmetic material causing a build up around the dispensing orifice.

Preferably, the compact comprises a stopper for the container of the dispenser hingedly connected to the lid by a further hinge.

Preferably the actuating linkage is flexible. Optionally, the actuating linkage is bowed. More preferably the plunger is hollow for dispensing liquid therethrough. Optionally, the actuator comprises a flexible tube in fluid communication with the plunger, where the end of the tube opposite the plunger is in fluid communication with a dispensing orifice. This provides sufficient slack in the tube when pressure is applied to the actuating linkage. The actuating linkage has one end connected to the plunger and the opposite end connected to the dispensing orifice.

In one aspect of the present invention, the end of the flexible tube and/or the plunger is supported in a cradle movable along guide tracks. This limits any lateral movement of the plunger during actuation of the pump-dispenser by the application of pressure to the actuating linkage.

Optionally, the dispensing orifice is connected to the inner lid and in fluid communication with the flexible tube.

In another aspect of the present invention, the cosmetic container comprises a container housed in an outer rigid casing in which the container comprises a flexible wall which allows the wall to collapse as liquid is dispensed from the container so that a constant pressure is applied to expel the liquid. In this way, the dispenser can be used in any orientation of the dispenser without reducing the ability for the liquid to be expelled from the container. This pressure may be atmospheric pressure acting externally of the container wall or an externally applied elevated pressure.

The outer rigid casing prevents any mis-handling of the container and accidental application of pressure to the flexible wall of the container when handled. Thus a replacement container can be easily assembled onto the pump-dispenser without soiling the hands. Moreover, a replacement container can easily be stored loosely or packaged without accidentally applying pressure to the flexible wall. Optionally the container is a flexible bag.

Preferably, the pump mechanism comprises a pump chamber in fluid communication with the interior of the container, a plunger and a valve mechanism; the plunger being slideably mounted in the pump chamber and movable from a rest position to a dispensing position to vary the volume of the pump chamber and to expel liquid from the container. The plunger may be biased towards the rest position.

In one arrangement, the pump mechanism draws liquid from the container. In another arrangement, an air space is formed between the container and the outer rigid casing. The pump-mechanism is arranged to apply pressure in the air space so that the flexible wall of the container collapses causing the liquid to be expelled from the container.

Preferably, the valve mechanism, shown as "V" in FIG. 5, comprises a non-return valve. This prevents cosmetic material from exuding from the dispensing orifice when the pump mechanism is not actuated by the button. For example, atmospheric pressure acting externally on the container may otherwise cause cosmetic material to inadvertently exude from the dispensing orifice causing material to build up around the orifice and disrupting the closing of the lid on the base of the cosmetic case. More preferably, the valve mechanism "V" comprises an inlet valved in fluid communication with the container and an outlet valve.

BRIEF DESCRIPTION OF THE DRAWINGS

Further preferred features and aspects of the present invention will be apparent from the claims and the following illustrative description made with reference to the accompanying drawings in which:

FIG. 4 is a perspective view of the cosmetic compact of FIG. 1 when the lid is open, showing the inner lid and the container;

FIG. 5 is a schematic representation of the container of the cosmetic compact;

DESCRIPTION OF THE PREFERRED EMBODIMENT

Figure 1:
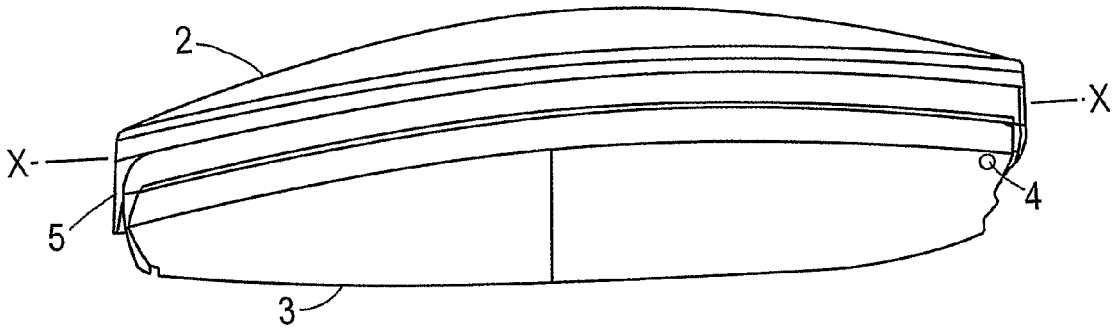
FIG. 1 is a side view of a cosmetic compact comprising a cosmetic dispenser embodying the invention when the lid is closed.

The cosmetic compact 1 shown in FIG. 1 comprises a lid 2 and a base 3 connected by a hinge 4 such as a hinge pin. The lid further comprises a latch 5 which serves to hold the lid 2 closed against the base 3.

Figure 2:
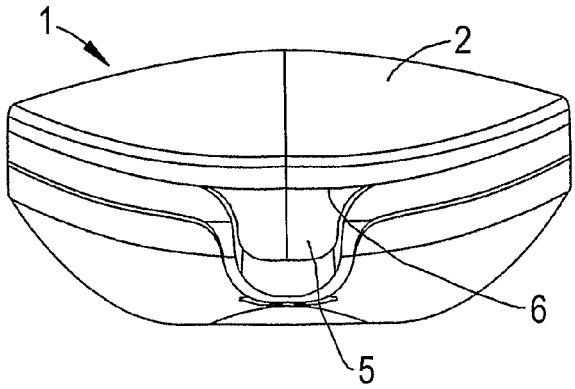
FIG. 2 is a front view of the cosmetic compact of FIG. 1 when the lid is closed.

FIG. 2 shows a front view of the cosmetic compact 1. The latch 5 is a flap connected to the lid 2 by a hinge 6. When the lid is closed, the compact provides a smooth casing that is ergonomically friendly, appealing to the eye and easy to handle. In the particular embodiment, the compact is pebble-shaped but other shapes are available that are ergonomically friendly such as a round compact.

Figure 3:
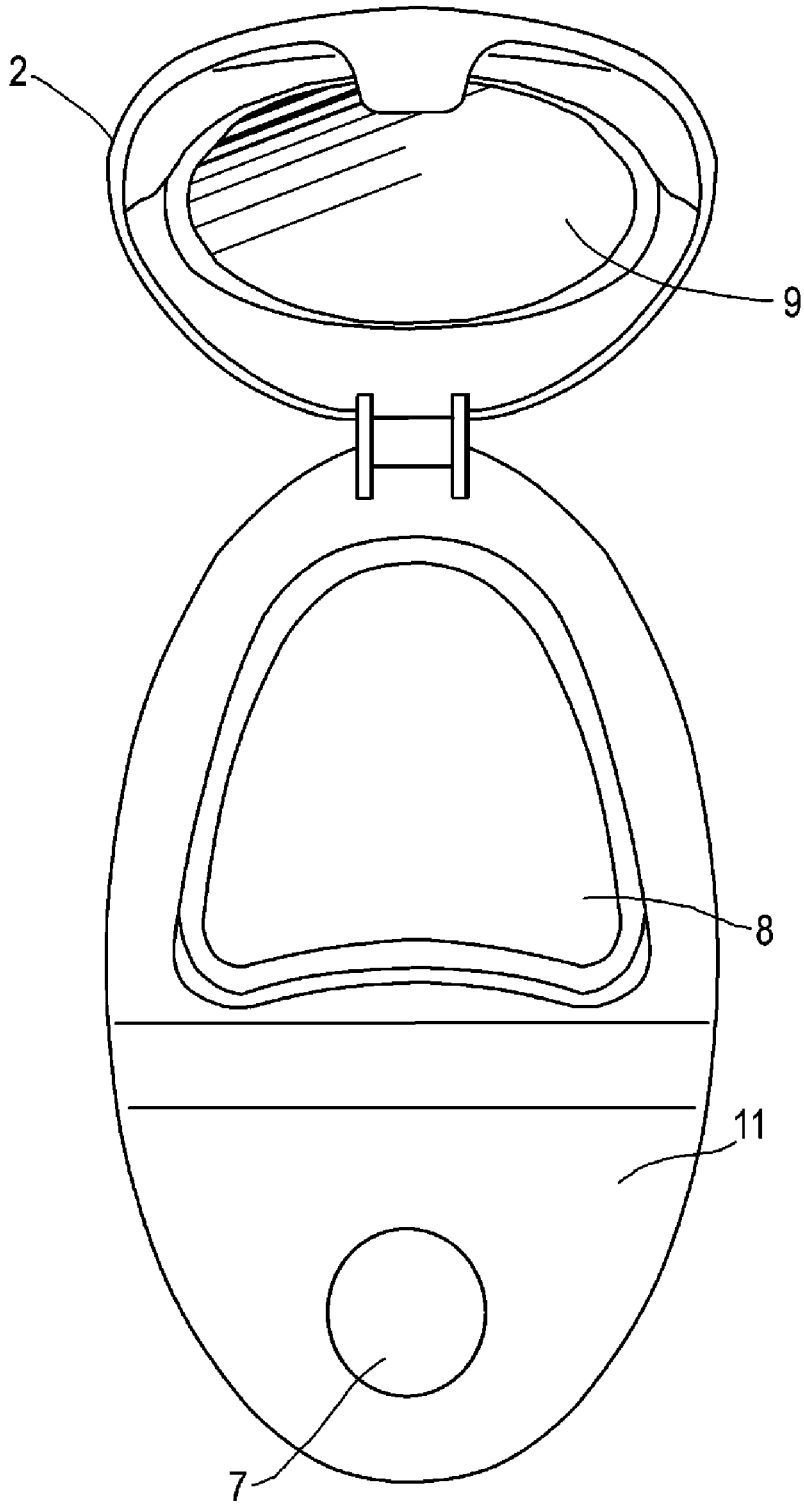
FIG. 3 is a perspective view of the cosmetic compact of FIG. 1 when the lid is open.

When the lid 2 is open as shown in FIG. 3, the compact presents a dispensing button 7, and a recess 8 for storing an applicator such as a sponge, puff etc. In use the button 7 is depressed by the user to expel the cosmetic liquid material. The lid 2 may further comprise a mirror 9 attached to its underside.

As shown in FIG. 4, the button 7 for actuating the dispenser 10 is provided on an inner lid 11. The position of the button 7 on the inner lid 11 is such that when the inner lid is closed on the base 3, the button 7 is located above the actuating mechanism 12 of the dispenser 10. Thus when the button is depressed by the user, the actuating mechanism 12 is actuated causing the liquid cosmetic material to be expelled from the compact 1. Further details of the actuation mechanism 12 are discussed later. For clarity and simplicity, certain parts of the actuating mechanism are omitted from FIG. 4.

The liquid cosmetic product is held in a container 13. Typical containers known in the art include a tubular container having collapsible walls. As shown in FIG. 4, the container 13 is a tottle substantially covering the entire floor within the base 3. ("Tottle" is a term recognised in the packaging field, denoting a container that may be regarded as a hybrid between a tube and bottle, hence the name). The container 13 is attached onto a pump-type dispenser 14. Any pump-type dispenser known in the art suitable for dispensing liquid cosmetics from the container 13 can be used. Typical pump-type dispensers comprise a pump chamber in which a plunger or piston (35, FIG. 7) is slideably mounted. By varying the volume of the pump chamber, the material to be dispensed is expelled. Means to vary the volume of the pump chamber include applying pressure to a plunger rod so as to cause the plunger to slide within the pump chamber. Typical pump-type dispensers are described in US2002/0175189 (Petit, Ludovic) and US2003/0155378 (Petit, Ludovic). The pump-type dispenser 14 can be attached onto the container by a snap-fit arrangement or by crimping.

FIG. 5 shows a schematic plan view of the container 13 according to the present invention. The container 13 comprises of an outer rigid casing and an inner container 16. At least one wall of the inner container is supple or flexible, or the entire inner container 16 can be a flexible bag. The cosmetic material is stored in the inner container 16. The outer, relatively rigid casing 15 can be a moulded body such as an injection moulding. Having an outer rigid casing 15 permits the container 13 to be handled without accidentally pressing the flexible wall of the inner container 16 and soiling the user's hands. Any material for the outer casing 15 can be used to provide the necessary higher rigidity such as plastic, metal, etc. The flexible wall of the inner container 16 can be made from rubber or elastomeric or flexible polymeric material that sufficiently collapses when the liquid cosmetic material is expelled from the container 13. The inner container 16 can be filled by vacuum methods known in the art to provide an airless system. This allows the flexible wall of the inner container 16 to collapse on the liquid cosmetic material so as to allow the cosmetic compact to be used in any orientation without affecting the ability to dispense the liquid cosmetic or lose any dispensing pressure. The pump-type dispenser 14 can be arranged such that the liquid cosmetic is drawn from the container into the pump chamber as is commonly known in the art. Optionally the pump-type dispenser 14 can be arranged to introduce fluid such as air in the space 18 between the outer rigid casing 15 and the inner container 16 (see FIG. 5). In the latter case, the fluid pressure built up around the flexible wall causes the liquid cosmetic to be expelled from the container 13. For the latter arrangement to work, the outer rigid casing 15 and the inner container 16 must be sealed together to provide the pressurisable space. However, in the former case, whereby the pump-type dispenser 14 is arranged to draw liquid into the pump chamber, the outer rigid casing 15 must be vented to atmosphere. The container 13 has a neck 17 by which it is attached to the pump-type dispenser 14 as described above.

Figure 6:
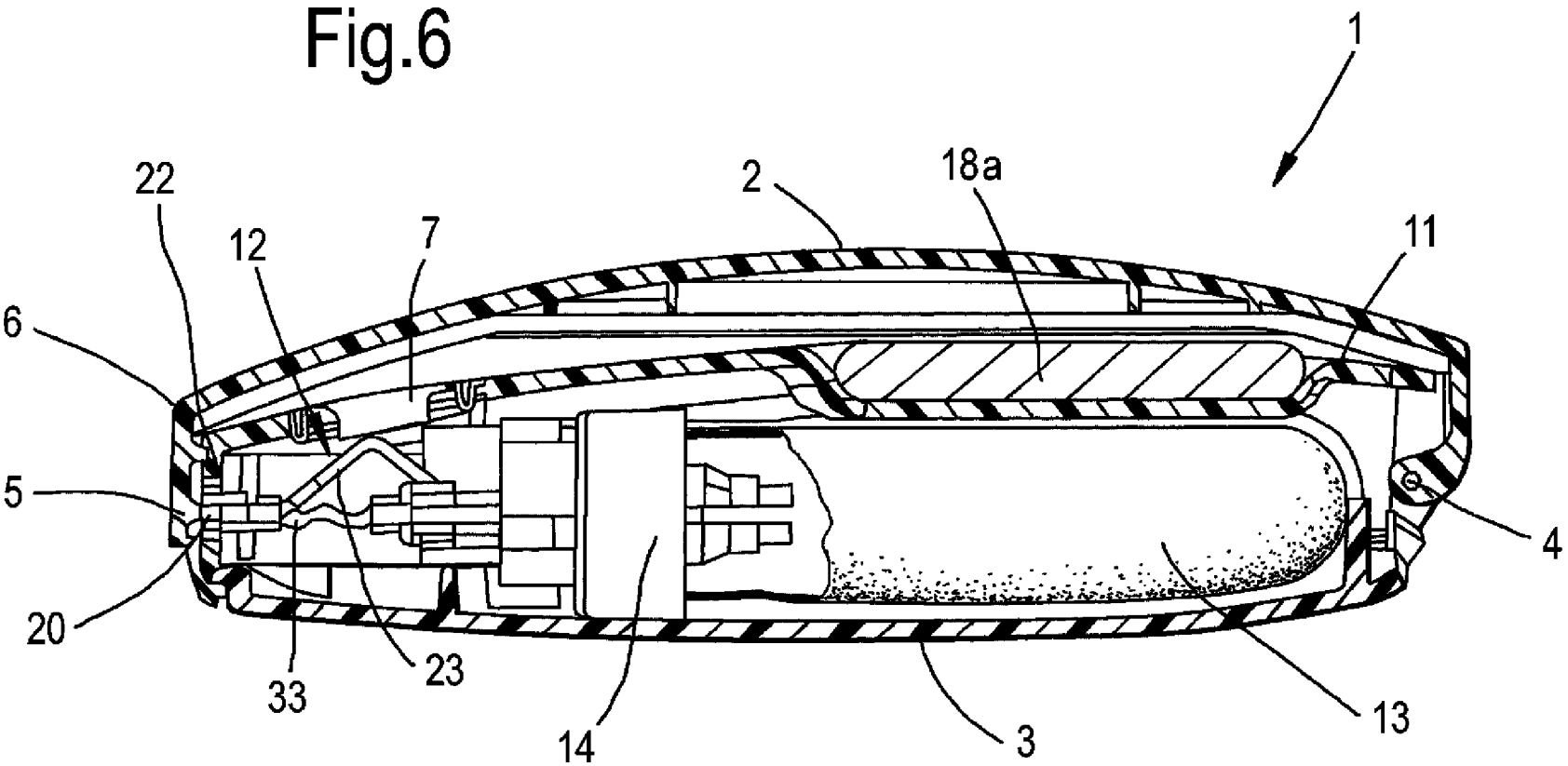
FIG. 6 is a vertical, longitudinal cross-section view of the cosmetic compact.

A cross-sectional view of the cosmetic compact 1 in the closed configuration is shown in FIG. 6. As shown in the closed state, the compact conveniently houses the container 13, the pump-type dispenser 14, the actuating mechanism 12 and an applicator 18 such as a sponge. The container 13 is located in a recess formed in the base of the compact. The cosmetic liquid material in the container 13 is dispensed from a dispensing orifice. In this embodiment, the dispensing orifice is located at the front of the cosmetic compact 1. The hinge 6 of the latch flap 5 is shown as a thin flexible web integrally formed with the lid 2 and latch flap 5. However, other means to connect the latch flap 5 to the lid 2 by means of a hinge known in the art are permissible. In some instances, a separate stopper can be provided that is not connected to the lid 2. In other instances, the latch flap 5 may be resilient and more rigidly attached to the lid 2, to provide a snap-engagement with the base 3.

The latch flap 5 comprises a protrusion 22 which cooperates with a dispensing nozzle 20 in fluid communication with the tottle or other suitable container 13 as further explained below. The protrusion 22 is shaped such that it snugly fits into the exit orifice of the nozzle 20 in the front face of the cosmetic compact 1 or is inserted into and held in the orifice of the nozzle 20 by a snap-in arrangement. As can be seen from FIGS. 6 and 7, the actuating mechanism 12 comprises a toggle type linkage 23 which is offset from the axis Y-Y which is nominally the axis of movement of the plunger. The actuating linkage 23 can be flexible or bowed. The actuating linkage 23 is located below the button 7 such that when pressure is applied to the button 7 axial force is imparted to the plunger causing the plunger to slide in the pump chamber. In this way, a user can actuate the dispenser substantially transversely of the plunger axis. A typical actuating mechanism 12 of this kind is described in WO0144076 (TECHNIPLAST; LAMBOUX JEAN PHILIPPE).

Figure 7:
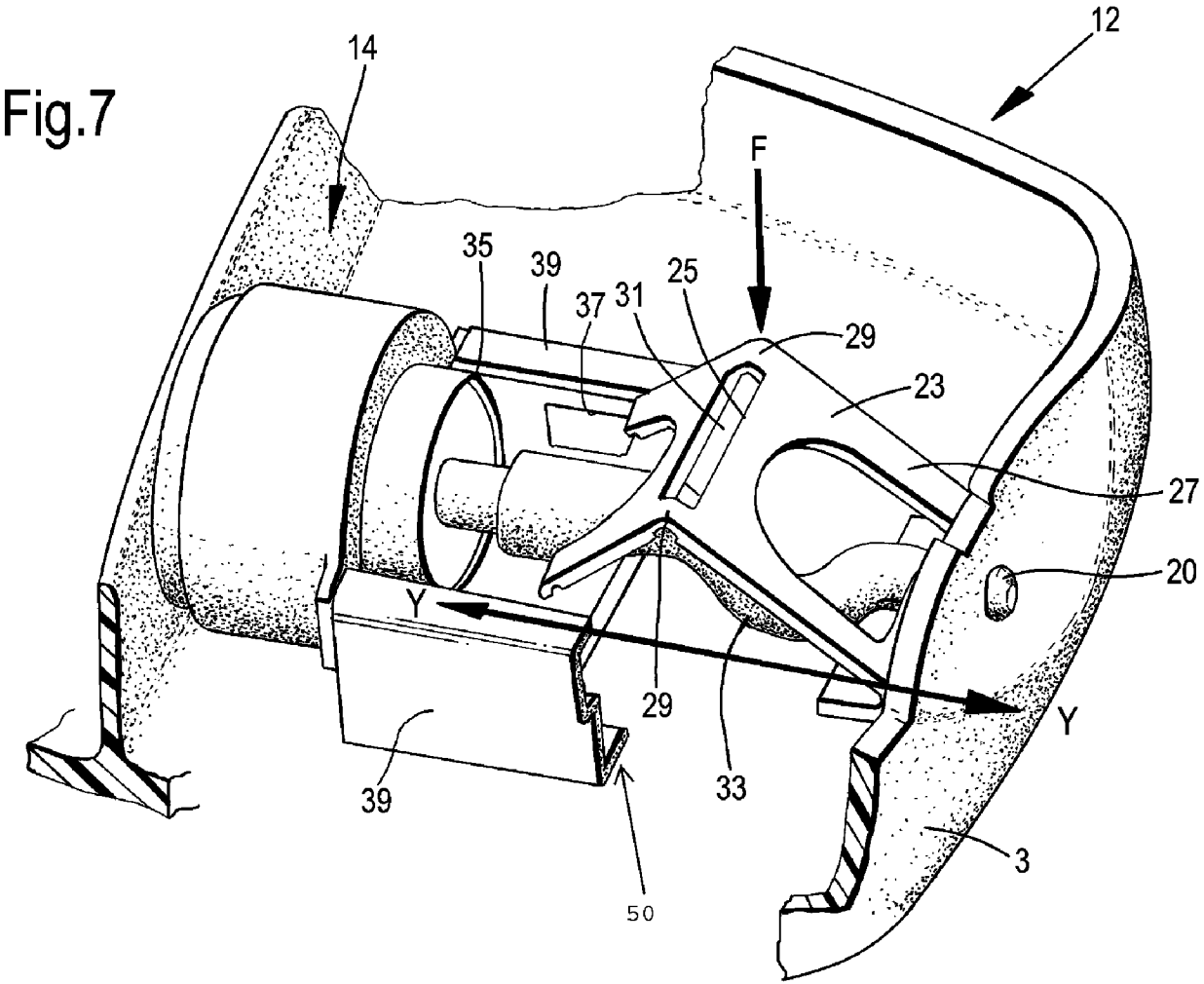
FIG. 7 is a schematic representation of the actuating mechanism.

FIG. 7 shows an expanded view of the actuation mechanism 14. The linkage 23 comprises a pair of relatively rigid arms 25, 27 connected at a flexible hinge formed by webs 29 situated at either end of a central transverse slot 31. When transverse force F is applied to the linkage 23 in the region of the hinge via the button 7, the arms 25, 27 of the actuating linkage pivot outwards in the direction Y along the axis of the plunger. The free ends of the arms bear on the dispensing orifice and plunger respectively. Preferably the free ends of the arms of the actuating linkage are connected to the dispensing orifice and plunger respectively. The actuating mechanism further comprises a flexible tube 33 in fluid communication with the plunger and nozzle 20. In the particular embodiment, the plunger is hollow. The flexible tube provides slack allowing relative axial movement between the plunger and the nozzle. The end of the tube connected to the plunger can be connected by any pipe connection known in the art so as to provide a leak-tight seal. Moreover, the end of the actuating linkage 23 and/or the plunger and the connected end of the flexible tube can be supported in a cradle 37 movable along guide tracks 50 provided by a frame 39. This provides sufficient support to prevent the plunger and the tube being displaced by the lateral forces applied to it by the linkage 23.

In use, the user simply lifts the lid 2 and presses the button 7 to expel the liquid cosmetic from the compact.

The present invention greatly improves the design flexibility of the cosmetic container and removes the need to have any unsightly protruding buttons and the like. Thus a cosmetic container can be manufactured that is more aesthetically pleasing and ergonomically friendly. It also improves the manufacturability of the cosmetic compact such as by injection moulding without the need for complex components. The dispenser can be manufactured by simply attaching the actuating mechanism onto the container by any suitable snap-fit arrangement.

The invention claimed is:

1. A cosmetic compact comprising a lid hingedly connected to a base, a dispensing orifice, a cosmetic dispenser for dispensing liquid cosmetics disposed in a recess in the base, the cosmetic dispenser comprising a pump type dispenser attached to a container that is configured to hold a liquid cosmetic product and an actuator, wherein the pump type dispenser comprises a pump chamber in which a plunger is slidably mounted, the plunger having an axis of movement, the pump type dispenser being operatively connected to the actuator so as to actuate the dispenser, the actuator being attachable to the plunger of the pump type dispenser and comprising an actuating linkage having a portion offset to the axis of movement of the plunger, such that when pressure is applied to the actuating linkage in a direction transverse to the axis of movement of the plunger, the plunger moves axially, wherein the compact further comprises an inner lid comprising a recess for storing an applicator, the inner lid hingedly connected to the base, wherein the lid, the base, and the inner lid are pivotable about the same hinge, the inner lid comprising a button in cooperation with the actuator such that when pressure is applied to the button the plunger moves axially to expel liquid from the dispensing orifice.

2. A cosmetic compact as claimed in claim 1, wherein the dispensing orifice is located in an end wall of the cosmetic compact.

3. A cosmetic compact as claimed in claim 1, wherein the compact comprises a protrusion that cooperates with the dispensing orifice.

4. A cosmetic compact as claimed in claim 3, wherein the protrusion is hingedly connected to the lid.

5. A cosmetic compact as claimed in claim 1, wherein the actuating linkage is flexible.

6. A cosmetic compact as claimed in claim 1, wherein the actuating linkage is bowed.

7. A cosmetic compact as claimed in claim 1, wherein the plunger is hollow for dispensing liquid therethrough.

8. A cosmetic compact as claimed in claim 1, wherein the actuator comprises of a flexible tube in fluid communication with the plunger.

9. A cosmetic compact as claimed in claim 8, wherein an end of the tube opposite the plunger is in fluid communication with the dispensing orifice.

10. A cosmetic compact as claimed in claim 9, wherein the actuating linkage has one end connected to the plunger and an opposite end connected to the dispensing orifice.

11. A cosmetic compact as claimed in claim 8, wherein an end of the flexible tube is supported in a cradle moveable along guide tracks provided by a frame.

12. A cosmetic compact as claimed in claim 8, wherein the dispensing orifice is connected to the inner lid and in fluid communication with the flexible tube.

13. A cosmetic compact as claimed in claim 1, wherein the container comprises an outer rigid casing and an inner container, the inner container comprising a flexible wall which collapses so that liquid may be expelled from the container in any orientation of the cosmetic compact.

14. A cosmetic compact as claimed in claim 13, wherein the inner container is a flexible bag.

15. A cosmetic compact as claimed in claim 13, wherein the container is substantially entirely filled with the liquid.

16. A cosmetic compact as claimed in claim 13, wherein the pump type dispenser draws liquid from the container.

17. A cosmetic compact as claimed in claim 13, wherein an air space is formed between the inner container and the outer rigid casing.

18. A cosmetic compact as claimed in claim 13 wherein the pump type dispenser comprises a pump chamber in fluid communication with the interior of the container, and a valve mechanism; the plunger being slideably mounted in the pump chamber by being supported in a cradle movable along guide tracks provided by a frame and moveable from a rest position to a dispensing position to vary the volume of the pump chamber and to expel liquid from the container.

19. A cosmetic compact as claimed in claim 18, wherein the plunger is biased towards the rest position.

20. A cosmetic compact as claimed in claim 18 wherein the valve mechanism comprises a non-return valve.

21. A cosmetic compact as claimed in claim 18 wherein the valve mechanism comprises an inlet valve in fluid communication with the container and an outlet valve.

22. A cosmetic compact as claimed in claim 11, wherein the plunger is supported in the cradle movable along guide tracks provided by the frame.

* * * * *